US007150633B2

(12) United States Patent
Ishikura et al.

(10) Patent No.: US 7,150,633 B2
(45) Date of Patent: Dec. 19, 2006

(54) ELECTRIC APPARATUS

(75) Inventors: Masayuki Ishikura, Mie (JP); Masatoshi Koike, Mie (JP); Jun Okada, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/106,543

(22) Filed: Apr. 15, 2005

(65) Prior Publication Data

US 2005/0239326 A1 Oct. 27, 2005

(30) Foreign Application Priority Data

Apr. 21, 2004 (JP) ..... P2004-125328
May 7, 2004 (JP) ..... P2004-138094

(51) Int. Cl.
*H01R 12/00* (2006.01)

(52) U.S. Cl. ..... 439/76.1; 439/926

(58) Field of Classification Search ..... 439/76.2, 439/76.1, 271, 568, 921
See application file for complete search history.

(56) References Cited

U.S. PATENT DOCUMENTS 4,850,884 A * 7/1989 Sawai et al. ..... 439/76.2
4,940,419 A * 7/1990 Kurita et al. ..... 439/271
5,764,487 A * 6/1998 Natsume ..... 361/775
6,336,830 B1 * 1/2002 Lee ..... 439/676
6,494,722 B1 * 12/2002 Sakamoto et al. ..... 439/76.2
6,719,572 B1 * 4/2004 Seo et al. ..... 439/76.2

FOREIGN PATENT DOCUMENTS

JP A 2002-359017 12/2002

* cited by examiner

*Primary Examiner*—Hien Vu
(74) *Attorney, Agent, or Firm*—Oliff & Berridge, PLC

(57) ABSTRACT

A circuit board is accommodated in a camera-housing and a connector housing portion formed integrally with the camera housing. An interior wiring has its one end connected to the circuit board and the other end connected to a connector terminal in a pressing state. The connector terminal is accommodated to be held in the camera housing, so that an external connecting connector portion is formed. An external connector located at an external harness is connected to the external connecting connector portion, so that a vehicle mounting camera apparatus is connected to an external apparatus through an external harness.

6 Claims, 6 Drawing Sheets

ELECTRIC APPARATUS

BACKGROUND OF THE INVENTION

1. Field of the Invention

The present invention relates to a technology for connecting an electric apparatus, such as a camera apparatus for vehicle, to other wirings.

2. Description of the Related Art

FIG. 10 shows a related art for connecting a vehicle mounting camera apparatus to another controller or power supply.

In FIG. 10, a vehicle mounting camera apparatus 510 has an image pickup element mounted therein and at the same time has a substrate 512 forming a power supply circuit or signal processing circuit accommodated in a case body 511. In addition, the vehicle mounting camera apparatus 510 is connected to another controller or power supply through a harness 520 in the apparatus side and a harness 530 in the car side.

The harness 530 in the car side has its one end connected to another controller or power supply, and has the other end thereof connected to the connecting connector 532 in the apparatus side. In general, the harness 530 in the car side is configured by a group of electric wires 530*a* each having a relatively large diameter.

The harness 520 in the apparatus side has its one end connected to a connected connector 522 in the apparatus side, and the harness 520 in the apparatus side is connected to the harness 530 in the car side through interconnection of the connected connector 522 in the apparatus side and the connecting connector 532 in the apparatus side. In addition, the harness 520 in the apparatus side has the other end connected to a connecting connector 524 in the substrate side, the harness 520 in the apparatus side is connected to the substrate 512 through interconnection of the connecting connector 524 in the substrate side and a connector 513 provided on the substrate 512.

Further, in the harness 520 in the apparatus side, a portion at the harness 530 in the car side becomes a first harness portion 521 in the apparatus side which is configured by a group of electric wires 521*a* each having a relatively large diameter, and a portion at the substrate 512 becomes a second harness portion 523 in the apparatus side which is configured by a group of electric wires 523*a* each having a relatively small diameter. In addition, the first harness portion 521 in the apparatus side and the second harness portion 523 in the apparatus side are interconnected through a connecting portion 525.

Here, the harness 520 in the apparatus side is configured by the first harness portion 521 in the apparatus side and the second harness portion 523 in the apparatus side.

The connector 513 formed on the substrate 512 is extremely compact so that it is necessary that the connecting connector 524 in the substrate side connected to the connector 513 be compact as well in accordance with the compactness of the connector. In this case, it is also necessary that an electric wire connected to an individual connector terminal of the connecting connector 524 in the substrate side have a relatively small diameter. Therefore, it is necessary that a portion at the substrate 512 in the harness 520 in the apparatus side use the second harness portion 523 in the apparatus side configured by a group of the plurality of electric wires 523*a* each having a relatively small diameter.

On the other hand, the harness 530 in the car side provided over a long path at the car side is configured by a group of electric wires 530*a* each having a relatively large diameter, whereby it is necessary that the connecting connector 532 in the apparatus side connected to the end portion of the harness 530 in the car side have a large size in accordance with the size the harness in the car side. In this case, it is also necessary that the connected connector 522 in the apparatus side connected to the connecting connector 532 in the apparatus side have a large size. Furthermore, it is necessary that the electric wires connected to the individual connector terminals of the large-sized connected connector 522 in the apparatus side use electric wires each having relatively large diameters. Therefore, it is necessary that a portion at the harness 530 in the car side in the harness 520 in the apparatus side use the first harness portion 521 in the apparatus side configured by a group of electric wires 521*a* each having a relatively large diameter.

For this reason, it is preferable that the harness 520 in the apparatus side be configured by the first harness portion 521 in the apparatus side and the second harness portion 523 in the apparatus side.

Further, the connecting portion 525 is disposed at the outside of the case body 511, whereby it is necessary that the connecting portion 525 be waterproofed. There is a technology in which connection portions between electric wires are covered with a thermal contracting tube and an outer circumference of the thermal contracting tube is sealed with an epoxy resin, as a construction for allowing the connection portions between the electric wires to be waterproofed or for air ventilating, as shown in JP-A-2002-359017.

In addition, according to the related art, the connecting connector 524 in the substrate side is connected to the connector 513 located at the substrate 512, and the harness 520 in the apparatus side is drawn out the exterior of the case body 511 through a drawing-out hole formed in the case body 511. In addition, in the drawing-out hole, a grommet 528 made from rubber is provided between a circumferential edge of the drawing-out hole and the harness 520 in the apparatus side, so that it is possible to prevent the water from getting into the case body 511. In addition, at the outside of the case body 511, the connecting connector 532 in the apparatus side and the connected connector 522 in the apparatus side are interconnected, so that the harness 520 in the apparatus side and the harness 530 in the car side are interconnected.

SUMMARY OF THE INVENTION

However, in the related art, the harness 520 in the apparatus side is drawn out of the vehicle mounting camera apparatus 510, and the harness 520 in the apparatus side is connected to the harness 530 in the car side, whereby it is necessary to change a length of the harness 520 in the apparatus side depending upon position where the vehicle mounting camera apparatus 510 is mounted or kinds of cars on which the vehicle mounting camera apparatus 510 is supposed to be mounted. For this reason, it is necessary to manufacture and manage various kinds of vehicle mounting camera apparatuses 510 including the apparatus side harnesses 520 each having a different length depending upon position where the vehicle mounting camera apparatus 510 is mounted or kinds of cars on which the vehicle mounting camera apparatus 510 is supposed to be mounted.

Furthermore, the harness 520 in the apparatus side has the structure that the first harness portion 521 in the apparatus side configured by a group of electric wires 521*a* each having a relatively large diameter and the second harness portion 523 in the apparatus side configured by a group of electric wires 523*a* each having a relatively small diameter are interconnected through the connecting portion 525. Therefore, in the middle of the connection, it is necessary that the electric wire 521*a* having a relatively large diameter be connected to the electric wire 523*a* having a relatively small diameter so that the diameters of the electric wires is changed. In addition, it is necessary that the connection portion be waterproofed by the thermal contracting tube or sealing resin. As a result, the structure becomes complicated and the manufacturing process becomes complicated.

Accordingly, an advantage of the present invention is to provide a technology which contributes to save efforts accompanied by a quality control, and has an easy manufacturing process and a simple structure.

According to one aspect of the invention, there is provided with an electric apparatus includes: an interior electric component having an interior connector; a housing having an accommodating case portion accommodating the interior electric component and a connector housing portion; an interior wiring of which one end is electrically connected to the interior electric component through the interior connector; and an interior wiring member having a connector terminal connected to the other end of the interior wiring, wherein the connector terminal is accommodated to be held in the connector housing portion. The connector terminal is formed in an external connecting connector portion capable of connecting an external connector attached to one end of an external harness.

By thus configuration, the external connector in the external harness side is connected to the external connecting connector portion, so that the electric apparatus is connected to the external apparatus. As a result, it is not necessary to draw out the external connecting harness. Further, it is necessary to manage various kinds of vehicle mounting camera apparatuses depending upon position where the vehicle mounting camera apparatus is mounted to thereby contributing to save efforts accompanied by a quality control and to have an easy manufacturing process and a simple structure.

Furthermore, the interior wiring is connected to the external harness through the external connecting connector portion, whereby it is not necessary that the electric wire having a relatively large diameter and the electric wire having a relatively small diameter be interconnected and the connection portion between the electric wires be waterproofed at the outside of the electric apparatus, as in the related art. Therefore, it is possible to easily manufacture the electric apparatus and to secure a simple construction.

It is preferable that the external connecting connector portion include the water-proof connector that is connected in a water-proof manner to an external connector on the other side.

By thus configuration, it is possible to prevent the water from entering the housing, When the external connecting connector portion has the water-proof connector that is connected in a water-proof manner to an external connector on the other side.

It is preferable that the external connecting connector portion include the water-proof connector that is connected in a water-proof manner to an external connector on the other side.

By thus configuration, the connector housing portion is formed integrally with a wiring extracting portion of the accommodating case portion, whereby it is possible to have a simple construction and to have a portion between the connector housing portion and the accommodating case portion waterproofed reliably.

It is preferable that the connector housing portion and the wiring extracting portion of the accommodating case portion be made from a flexible resin to be integrally formed.

Moreover, the connector housing portion and the wiring extracting portion of the accommodating case portion are made from a flexible resin to be integrally formed, the connecting portion such as the locking portion or the like can be easily formed in the connector housing portion.

It is preferable that the interior wiring and a dummy electric wire be pressed on a pressing portion of the connector terminal.

In addition, the interior wiring and a dummy electric wire are pressed on a pressing portion of the connector terminal, whereby the wiring having a relatively small diameter is ensured to be pressed on the connector terminal having a relatively large diameter.

It is preferable that the interior wiring members, the dummy electric wires, and the connector terminals be formed in the plural number respectively, each of the interior wiring members and each of the dummy electric wires be pressed on each of the pressing portion of each of the connector terminals, and the connector housing portion have partition walls for dividing the respective dummy electric wires.

In this case, the connector housing portion has partition walls for dividing the respective dummy electric wires. Therefore, the partition wall can prevent a short circuit between the dummy electric wires from being generated.

It is preferable that the interior wiring members, the dummy electric wires, and the connector terminals be formed in the plural number respectively, each of the interior wiring members and each of the dummy electric wires be pressed on each of the pressing portion of each of the connector terminals, and each of the dummy electric wires be covered with an insulating member.

Further, the dummy electric wire is covered with the insulating member. Consequently, the insulating member can prevent a short circuit between the dummy electric wires from being generated.

According to another aspect of the invention, an electric apparatus includes: an interior electric component having a component side connector and a housing including the interior electric component at inside thereof. An inner face side of the housing is integrally provided with an inner connector portion connected with the part side connector. An outer face side of the housing is integrally provided with an outer connector portion electrically connected with the external harness. Respective connector terminals of the inner connector portion and respective connector terminals of the outer connector portion are respectively connected by connection conductors arranged in the housing.

By thus configuration, it is not necessary to penetrate the harness into the housing to draw out therefrom as in the background art, which can promote integrating operability.

Further, the respective connector terminals of the inner connector portion and the respective connecter terminals of the outer connector portion are respectively connected by the connection conductors and therefore, it is not also necessary to change the electric wire diameter in the electric wire path as in the background art.

Further, the connection conductor in the housing also serves to change the electric wire diameter, which has been carried out at outside of the electric apparatus of the background art to achieve an advantage that compact formation is achieved and in connecting to the external harness, the external harness may electrically be connected to the outer connector portion of the housing.

Further, when the connection conductor is arranged in the housing to insert molding, the electric apparatus can easily be fabricated.

Further, when the outer connector portion is made to be able to connect the harness side connector provided at the end portion of the external harness, the harness side connector of the outer harness may directly be connected to the external side connector portion, which facilitates connecting operation.

Further, when the waterproof structure by which the outer connector portion and the harness side connector are connected in the waterproof state, invasion of water into the housing can effectively be prevented.

Further, when the relay harness having the relay connector the one end portion of which is electrically connected to the outer connector portion and the other end portion of which is made to be able to connect to the harness side connector provided at the end portion of the external harness, the outer connector portion and the external harness can electrically be connected via the relay harness, which can deal with a variety of connecting methods.

Further, when the waterproof structure in which the portion of connecting the outer connector portion and the relay harness and the relay connector and the harness side connector are respectively connected in the waterproof state, invasion of water in the respective connecting portions can effectively be prevented.

DESCRIPTION OF THE PREFERRED EMBODIMENTS

Hereinafter, an electric apparatus according to one embodiment of the present invention will be described. Here, an example in which a vehicle mounting camera apparatus is assumed as the electric apparatus will be described. However, the present invention may be generally applied to electric apparatuses, such as various kinds of electric apparatuses for car and general module apparatuses, which are electrically connected to an external apparatus through an external harness.

Figure 1:
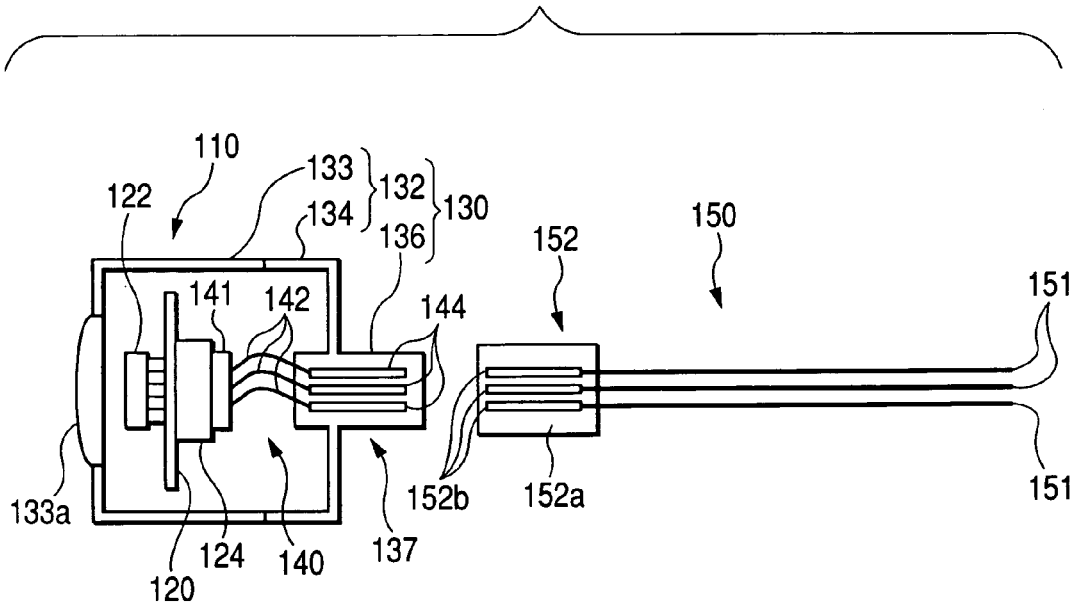
FIG. 1 is an explanatory view showing a vehicle mounting camera apparatus and an external harness according to one embodiment of the invention.
Figure 2:
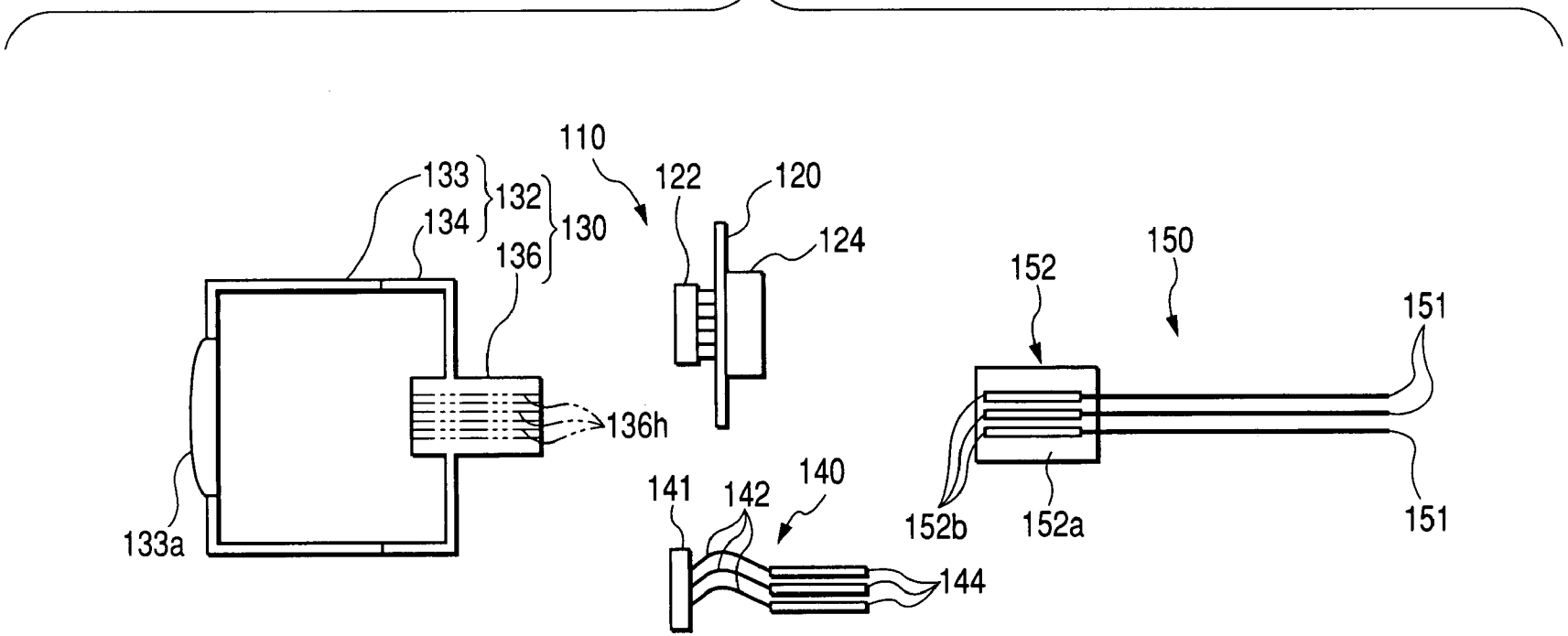
FIG. 2 is an exploded explanatory view of the vehicle mounting camera apparatus.

FIG. 1 is an explanatory view showing a vehicle mounting camera apparatus and an external harness and FIG. 2 is an exploded explanatory view of the vehicle mounting camera apparatus.

The vehicle mounting camera apparatus 110 is an apparatus which is mounted on a bumper or grill of a car to have a photograph for an outside view of the car taken. The vehicle mounting camera apparatus 110 is connected to a power supply or a display in a car through an external harness 150.

Here, in the external harness 150 has an external connector 152 attached to an end portion of a plurality of electric wires 151. As the electric wire 151, an electric wire having a relatively large diameter is used. Particularly, an electric wire that has a diameter greater than that of an interior wiring 142 in the vehicle mounting camera apparatus 110 (for example, a sectional area of 0.75 $mm^2$), which will be described later in detail, is used.

The external connector 152 has a plurality of connector terminals 152*b* each corresponding to the respective electric wires 151 incorporated in a connector housing 152*a*. The external connector 152 is adapted to be connected to an external connecting connector portion 137, which will be described later in detail. In order to correspond to the diameter of the electric wire 151, each of connector terminals 152*b* having a shape capable of pressing the electric wires 151 is used in accordance with a diameter of the electric lines.

The vehicle mounting camera apparatus 110 includes a circuit board 120, a camera housing 130, and an interior wiring member 140 as an interior electric component.

The circuit board 120 has an image pickup element 122 such as a CCD element and an interior connector 124 mounted thereon, and has a power supply circuit or a signal processing circuit relevant to the image pickup element 122 formed therein. The interior connector 124 has a connector terminal which supplies a power to the circuit board or transmits or receives signals to and from the circuit board. In addition, the interior connector 124 can be connected to an interior connector 141 in the wiring side, which will be described later in detail. The circuit board 120 is fixedly accommodated in a camera housing 130 by a screw in a state in which the outside view can be imaged by the image pickup element 122.

The camera housing 130 has an accommodating case portion 132 for accommodating the circuit board 120 and a connector housing portion 136.

The accommodating case portion 132 is provided in the form of a casing such that it can accommodate the circuit board 120. Here, the accommodating case portion 132 is divided into a front case 133 and a rear case 134. The front case 133 and the rear case 134 are combined with each other in a liquid tight manner by the screw or the like to form an integrated body.

The front case 133 is formed of a resin and has an image pickup window 133*a* incorporated in a principle surface thereof. In addition, the image pickup element 122 in the camera housing 130 is formed to have a photograph for the outside view taken through the image pickup window 133*a*.

In addition, the connector housing portion 136 is formed integrally with a principle surface being a wiring extracting portion in the rear case 134.

The connector housing portion 136 has a rectangular shape projecting into inside and outside of the rear case 134. In addition, the connector housing portion 136 has a plurality of terminal accommodating hole portions 136*h* formed therein. Each of the connector terminals 144, which will be described later in detail, is accommodated to be held in each of terminal accommodating hole portions 136*h* respectively with them locked. As a result, it is possible to form an external connecting connector portion 137 which can be connected to the external connector 152.

Further, it is preferable that the connector housing portion 136 and the rear case portion be made of resins, such as flexible resins, for example, polybutyleneterephthalate (PBT), nylon, and polyphenylenesulfide (PPS). As a consequence, it is possible to easily form a connector, such as a locking portion and a locked portion on the connector housing portion 136.

The interior wiring member 140 has a plurality of interior wirings 142 and a plurality of connector terminals 144. An end of each of the interior wirings 142 is connected to a connector terminal in the interior connector 141 in the wiring side. In addition, the interior connector 141 in the wiring side is connected to the interior connector 124 on the circuit board 120, so that each of the interior wirings 142 is electrically connected to the circuit board 120.

Figure 3:
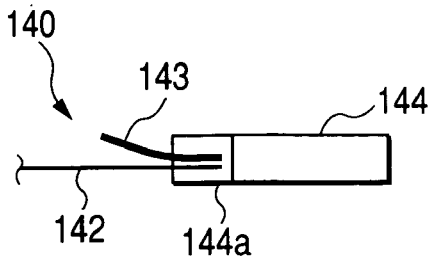
FIG. 3 is an explanatory view showing a state in which interior wirings are connected to a connector terminal.

Further, a core wire located at the other end of each of the interior wirings 142 is connected to each of the connector terminals 144. FIG. 3 is an explanatory view showing a state in which interior wirings are connected to a connector terminal. Here, the connector terminal 144 is pressed to be connected to the core wire of the interior wiring 142 and the core wire of the dummy electric wire 143.

In other words, the interior connector 124 mounted on the circuit board 120 is extremely small, whereby each of the connector terminals built in the interior connector terminal 124 has a small size. Therefore, each of the connector terminals built in the interior connector 141 in the wiring side which is connected to the interior connector 124 has a small size in accordance with a size of the interior connector 124. Further, in accordance with the small-sized connector terminal built in the interior connector 141 in the wiring side, each of the interior wirings 142 connected to the interior connector 141 in the wiring side has a relatively small diameter. Particularly, each of the interior wirings 142 has a diameter smaller than that in each of the electric wires 151 and has, for example, a sectional area of 0.15 $mm^2$.

On the other hand, as the connector terminal 152*b* built in the external connector 152 located at the external harness 150, the connector terminal 152*b* having a relatively large size is used in accordance with the electric wire 151 having a relatively large diameter in the external harness 150. Further, the connector terminal 144 built in the external connecting connector portion 137 which is connected to the external connector 152 has a large size in accordance with the connector terminal 152*b* having a relatively large size.

Furthermore, generally, the connector terminal 144 having a relatively large size allows the electric wires each having a relatively large diameter to be pressed into interconnection. For example, in a manner similar to the connector terminal 152*b* on the other side, the connector terminal 144 has a pressing portion which has a sectional area thereof is 0.75 $mm^2$ and has a size and shape to be suitable for pressing the electric wires each having a relatively large diameter. If so, even though the electric wire having diameter smaller than that of the pressing portion 144*a* of the connector terminal 144, for example, the interior wiring 142 having the sectional area of 0.15 $mm^2$ is pressed, the interior wiring 142 can not be pressed to be held or a force for pressing to hold the wiring is insufficient.

Therefore, the original interior wiring 142 for electric wiring and the dummy electric wire 143 cut in a predetermined length are pressed to be connected to the pressing portion 144*a* of the connector terminal 144, so that wire materials each having substantially the originally assumed diameter are pressed to be held in the pressing portion 144*a*. For example, the interior wiring 142 having a diameter of 0.15 $mm^2$ and the dummy electric wire 143 having a sectional area of 0.75 $mm^2$ are pressed to be connected to the pressing portion 144*a* of the connector terminal 144 designed for pressing the electric wire having a sectional area of 0.75 $mm^2$.

As described above, each of the connector terminals 144 connected to the other end of each of the interior wirings 142 in a pressing state is inserted into the terminal accommodating hole portion 136*h* at the connector housing portion 136 from inside of the rear case 134 to be fixed at a predetermined location in the terminal accommodating hole portion by a predetermined locking mechanism, as shown in FIGS. 1 and 2.

In the vehicle mounting camera apparatus 110 constructed in this way, the external connector 152 in the external harness 150 is connected to the external connecting connector 137, whereby the circuit board 120 serving as an interior electric apparatus is electrically connected to an external apparatus, such as an external controller or an external power supply, via the external connecting connector portion 137, the external connector 152, and the external harness 150 from the interior wiring member 140.

According to the vehicle mounting camera apparatus 110 as described above, the external connector 152 located at the external harness 150 is connected to the external connecting connector portion 137, so that the vehicle mounting camera apparatus 110 is connected to the external apparatus. As a result, it is not necessary to draw out the external connecting harness, as in the related art. In addition, it is not necessary to individually manage various kinds of harnesses each having a different length depending upon position where the vehicle mounting camera apparatus is mounted. This results in contribution to save efforts accompanied by a quality control.

Furthermore, through the external connecting connector portion 137, a diameter in each of the interior wirings 142 is converted into a diameter in each of the electric wires 151 of the external harness 150. For this reason, it is not necessary to connect the electric wire having a relatively large diameter to the electric wire having a relatively small diameter and to have the outside of the vehicle mounting camera apparatus waterproofed, as in the related art. Therefore, it is possible to achieve the easier manufacturing and simpler structure.

At this time, the interior wiring 142 and the dummy electric wire 143 are connected to the pressing portion 144*a* at the connector terminal 144 in a pressing state, whereby it is possible to connect the interior wiring 142 having a relatively small diameter to the connector terminal 144 more reliably, in which the electric line having a relatively large diameter is assumed to be pressed. In particular, there is an advantage in that the connector terminal 144, in which the electric wire pressing having a relatively large diameter and the connection to the connector terminal designed for the wiring having a relatively large diameter are assumed, can be used as it is.

Further, the connector housing portion 136 is formed integrally with the rear case 134, so that it is possible to simplify the structure by reducing the number of components. In addition, it is ensured to have a portion between the connector housing portion 136 and the rear case 134 waterproofed.

Furthermore, the connecting housing portion 136 and the rear case 134 are made from a flexible resin to be integrally formed, whereby it is able to easily provide a connecting mechanism, such as a locking portion, in the connecting housing portion 136.

In addition, according to the related art, the harness 520 having the connecting portion 525 in which the waterproofing and the ventilating processes are applied is weighty to thereby apply a strong force to an extracting portion of the vehicle mounting camera apparatus 110, since the harness 520 is drawn out the vehicle mounting camera apparatus 510. For this reason, it is necessary to firmly fix the vehicle mounting camera apparatus 510 to a car. On the other hand, since the harness is not drawn out in the vehicle mounting camera apparatus 110 according to the embodiment of the invention, it is not necessary to consider firmly fixing the vehicle mounting camera apparatus to a car as described above. This results in contribution to the reduction of the cost.

Figure 4:
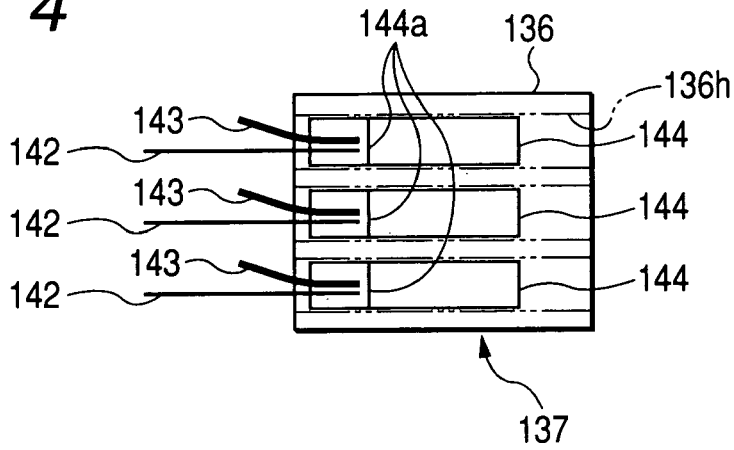
FIG. 4 is a view showing the relationship between a plurality of dummy electric wires.

However, when the interior wiring 142 and the dummy electric wire 143 having a predetermined length are connected to the pressing portion 144*a* of the connector terminal 144 in a pressing state, as shown in FIG. 4, the dummy electric wire 143 extrudes from the terminal accommodating hole portion 136*h* in a state in which the connector terminal 144 is accommodated to be held in the terminal accommodating hole portion 136*h* in the connector housing portion 136. In addition, a conductor is exposed on an end face of each of the dummy electric wires 143, there is a possibility that conductors in the dummy electric wires come into contact with each other.

Figure 5:
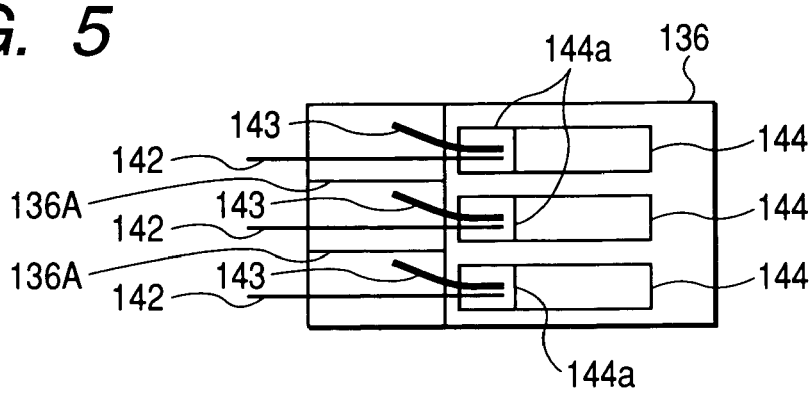
FIG. 5 is an explanatory view showing a modified example that partition walls are provided in a connector housing portion.

Therefore, as shown in FIG. 5, partition walls 136A for dividing the respective dummy electric wires 143 may be formed in a connector housing portion 136 corresponding to the connector housing portion 136.

Here, the partition walls 136A in the form of a plate are provided to be extended at least at locations between the respective dummy electric wires 143, on the inner surface side of the rear case 134 in the connector housing portion 136. In addition, the partition walls 136A may have a cylindrical shape in the connector housing portion 136 so as to surround the respective dummy electric wires 143.

Thereby, the partition walls 136A prevent a short circuit between the respective dummy electric wires 143 from being generated.

Figure 6:
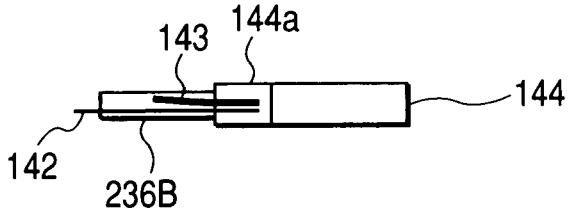
FIG. 6 is an explanatory view showing a state in which dummy electric wires are covered with an insulating member.

Further, as shown in FIG. 6, a portion in the dummy electric wire 143 which protrudes from the pressing portion 144*a* at the connector terminal 144 to the outside of the pressing portion 144*a* may be covered with an insulating member 236B.

Here, the part in the dummy electric wire 143 which protrudes from the pressing portion 144*a* at the connector terminal 144 to the outside of the pressing portion 144*a* and the interior wirings 142 are covered with the insulating member 236B. The insulating member 236B may be a thermal contracting tube to cover at least the end portion of the dummy electric wire 143 or an insulating tape wound around the end portion of the dummy electric wire 143.

In this case, the insulating member 236B prevents a short circuit between the respective dummy electric wires 143 from being generated as well.

However, in the connector terminal 144 shown in FIG. 3, when a terminal portion connected to the connector terminal 152*b* on the other side is formed in accordance with the original design for an electric wire having a large diameter and the pressing portion 144*a* is formed to have a shape which can press the interior wiring 142 having a relatively small diameter, it is not necessary that both of the interior wiring 142 and the dummy electric wire 143 be pressed on the pressing portion 144*a*. Therefore, it is possible not to provide the above-mentioned partition wall 136A or insulating member 236B. This results in contribution to the smaller size and easier assembling.

Figure 7:
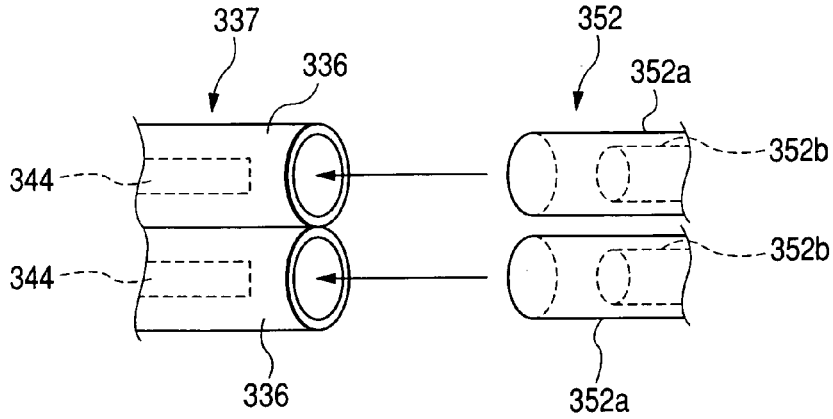
FIG. 7 is a view showing the waterproofing connector structure.

Further, as shown in FIG. 7, an external connecting connector portion 337 corresponding to the external connecting connector portion 137 may be configured to have a water-proof connector that is connected in a water-proof manner to the external connector 152 on the other side.

As shown in FIG. 7, it maybe exemplified that a connector terminal 344 is accommodated to be arranged in a cylindrical housing 336 as a structure of the water-proof connector. It may be also exemplified that an external connector 352 connected to an external connecting connector portion 137 has a cylindrical housing 352*a* capable of being fitted in the cylindrical housing 336 (or fitting round the cylindrical housing 336) and at the same time has a connector terminal 352*b* capable of being connected to the connector terminal 344 accommodated therein to be arranged.

Moreover, in a state in which the cylindrical housing 352*a* is fit in the cylindrical housing 336 to be interconnected, an outer circumferential portion of the cylindrical housing 352*a* and an inner circumferential portion of the cylindrical housing 336 is adhered closely with each other in a liquid tight manner, and a space defined by the cylindrical housing 352*a* and the cylindrical housing 336 forms a water-proof space. In addition, the connector terminal 344 and the connector terminal 352*b* are interconnected in the water-proof space.

As described above, the water-proof connector structure is employed, to thereby effectively preventing the water from getting into the external connecting connector portion 337 and a camera housing 130.

An electric apparatus according to other embodiments of the invention will be explained as follows. Although an explanation will be given here of an example conceiving a vehicle mounting camera apparatus as an electric apparatus, otherwise, the embodiment is applicable generally to an electric apparatus electrically connected to an external apparatus of various vehicle mounting the electric apparatus, general module apparatus and the like via an external harness.

Figure 8:
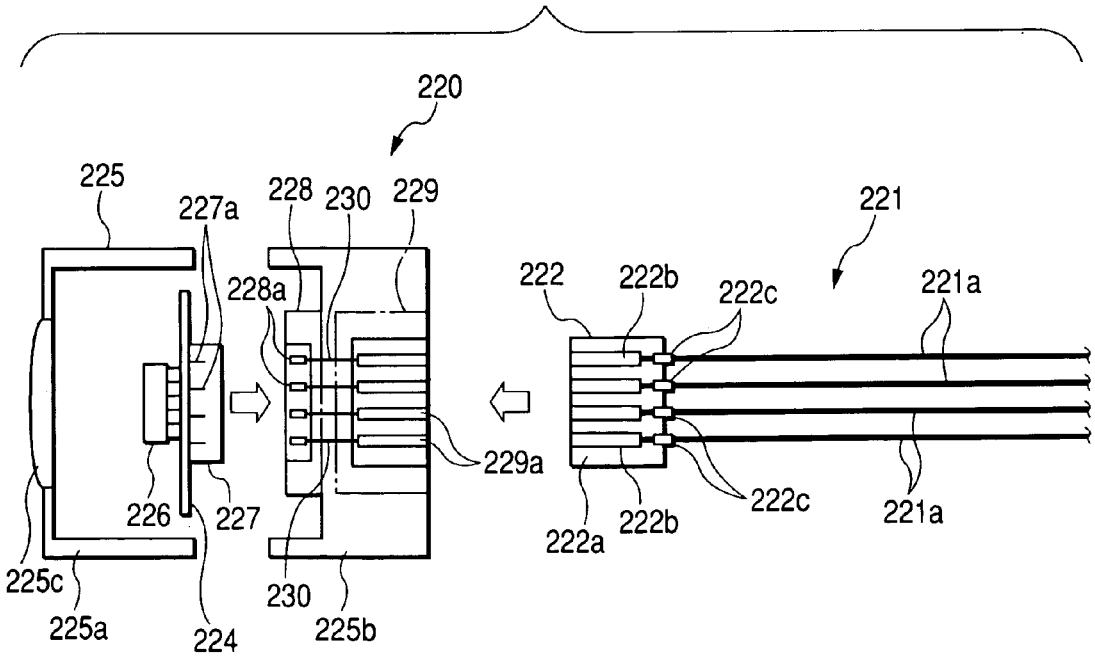
FIG. 8 is a disassembled explanatory view according to another embodiment of the invention.

FIG. 8 is an explanatory view showing a vehicle mounting camera apparatus 220 and an external harness 221 according to another embodiment, the vehicle mounting camera apparatus 220 is an apparatus installed at a bumper, a grille or the like of a vehicle for taking an image of a scenery outside of the vehicle and is constructed by a structure constituting a so-to-speak blind corner monitor, a back monitor or the like and connected to an external apparatus of a power source, a display apparatus in a vehicle compartment or the like via the external harness 221.

In this case, the external harness 221 includes a vehicle side harness attached with an external connector 222 as a harness side connector at end portions of a plurality of electric wires 221*a*. As the above-described respective electric wires 221*a*, electric wires having a comparatively bold diameter (for example, sectional area of 0.75 $mm^2$) are used from a view point of bending resistance.

The external connector 222 is respectively integrated with connector terminals 222*b* (for example, female terminals) in correspondence with the respective electric wires 221*a* at inside of a connector housing 222*a*. That is, as the respective connector terminals 222*b*, connector terminals having a shape with which the electric wires 221*a* having the comparatively bold diameter can be brought into press contact are used in accordance with the diameter of the electric wire 221*a*.

Further, end portions of the electric wires 221*a* with which the respective connector terminals 222*b* are brought into press contact are respectively mounted with waterproof plugs 222*c* respectively comprising rubber, flexible resin or the like to seal between the connector housing 222*a* and the respective electric wires 221*a* in liquid tight by the respective waterproof plugs 222*c* while the respective connector terminals 222*b* are integrated to the connector housing 222*a*.

The vehicle mounting camera apparatus 220 is configured by a circuit board 224 as an interior electric component, and a camera housing 225 as a case-like housing capable of containing the circuit board 224 at inside thereof.

The circuit board 224 is mounted with an image pick-up element 226 as a CCD element or the like and a board connector 227 as a component side connector. The circuit board 224 includes a power source circuit, a signal processing circuit and the like with regard to the image pick-up element 226. Further, the board connector 227 is provided with connector terminals 227*a* (for example, male terminals) for supplying power source to the circuit board or for transmitting and receiving signals. Further, the circuit board 224 is constituted by a structure of being contained in the camera housing 225 fixedly by screwing or the like at a position and in an attitude capable of taking an image of an outside scenery by the image pick-up element 226.

The camera housing 225 is configured by a structure of being divided in two of a front case portion 225*a* and a rear case portion 225*b* and is configured by a structure of assembling the both members by combining the both members pertinently by screwing or the like.

The front case portion 225*a* is formed by resin or the like and one main face thereof is integrated with an image taking window 225*c*. Further, the image pick-up element 226 in the camera housing 225 takes an image of an outside scenery through the image taking window 225*c*.

Further, also the rear case portion 225*b* is formed by resin or the like and is configured by a structure in which one main face thereof is formed in a thick-walled shape, an inner side of the main face is integrally provided with an inner connector 228 attachably and detachably connected with the board connector 227 by connector connection and an outer side of the main face is integrally provided with an outer connector 229 attachably and detachably connected with the outer connector 222 of the outer harness 221 by connector connection.

Further, the inner connector portion 228 is respectively arranged with connector terminals 228*a* (for example, female terminals) connected with the respective connector terminals 227*a* of the board connector 227, the outer connector portion 229 is respectively arranged with connector terminals 229*a* (for example, male terminals) connected with the respective connector terminals 222*b* of the external connector 222*c*, and the respective connector terminals 228*a* of the inner connector portion 228 and the respective connector terminals 229*a* of the outer connector portion 229 are respectively connected by respective connection conductors 230 arranged in the rear case portion 225*b* in an embedded state. In this case, the rear case portion 225*b* is configured by a structure similar to so-to-speak board to board connector.

At this occasion, the board connector 227 mounted to the circuit board 224 is very small and therefore, a small-sized one of the connector 227*a* included therein is used. Further, a small-sized one of the connector terminal 228*a* at the inner connector portion 228 connected to the board connector 227 by connector connection is used.

On the other hand, as the connector terminal 222*b* in the external connector 222 on a side of the external harness 221, in accordance with the electric wire 221*a* having the comparatively bold diameter in the external harness 221, a comparatively large-sized one of the connector terminal 222*b* is used. Further, as the connector terminal 229*a* of the outer connector portion 229 connected to the external connector 222 by connector connection, a large-sized one thereof is used in accordance with the comparatively large-sized connector terminal 222*b*.

Further, in integrating the vehicle mounting camera apparatus 220, the board connector 227 of the circuit board 224 may be connected to the inner connector portion 228 formed integrally with the inner face of the rear case portion 225*b* by connector connection and the front case portion 225*a* and the rear case portion 225*b* may be integrated.

Further, in connecting wires to the vehicle mounting camera apparatus 220 configured by a module structure, by connecting the external connector 222 of the external harness 221 to the outer connector portion 229 integrally formed with an outer face of the rear case portion 225*b* by connector connection, the circuit board 224 which is an inner electric apparatus is electrically connected to an external apparatus of an external control apparatus, an external power source or the like via the board connector 227, the inner connector portion 228, the connection conductor 230, the outer connector portion 229, the external connector 2 and the external harness 221.

The another embodiment is configured such that the inner face side of the rear case portion 225*b* is integrally formed with the inner connector portion 228, the outer face side is integrally formed with the outer connector portion 229, the respective connector terminals 228*a* of the inner connector portion 228 and the respective connector terminals 229*a* of the outer connector portion 229 are respectively connected by the connection conductors 230 configured by the shape of being embedded in the rear case portion 225*b*, in integrating the vehicle mounting camera apparatus 220, the board connector 227 of the circuit board 224 may be connected to the inner connector portion 228 of the rear case portion 225*b* by connector connection, the front case portion 225*a* and the rear case portion 225*b* may be integrated to each other, it is not necessary to penetrate the apparatus harness 4 to the housing 3 to draw out therefrom as in the background art and integration operability can be promoted.

Further, the respective connector terminals 228*a* of the inner connector portion 228 connected with the board connector 227 and the respective connector terminals 229*a* of the outer connector portion 229 connected with the external connector 222 are respectively connected by the connection conductors 230 and therefore, it is not also necessary to change the electric wire diameter in the electric wire path as in the background art.

Further, the connection conductor 230 in the rear case portion 225*b* also serves to change the electric wire diameter, which has been carried out outside of the vehicle mounting camera apparatus 510 of the related art, it is not necessary to draw out the harness 4 for external connection as in the background art and compact formation is achieved.

Further, it is not necessary to subject the electric wire having the comparatively bold diameter and the electric wire having the comparatively slender diameter to connection and waterproof processing at outside of the apparatus as in the background art to achieve an advantage of simplifying the structure and facilitating the fabrication and also reducing cost.

Further, in connecting wires, by directly connecting the external connector 222 of the external harness 221 to the outer connector portion 229 of the camera housing 225 by connector connection, the vehicle mounting camera apparatus 220 can be connected to an external apparatus to facilitate connecting operation.

Further, the inner connector portion 228 and the outer connector portion 229 are integrally formed at the rear case portion 225*b* to achieve an advantage of capable of simplifying the structure by reducing a number of parts and firmly achieving waterproof between the rear case portion 225*b* and the inner connector portion 228 and the outer connector portion 229.

Further, there may be adopted a waterproof structure in which when an interval between an inner face side of a fitting recess portion of the outer connector portion 229 fitted with the external connector 222 and an outer face side of the external connector 222 is arranged with a waterproof seal member or the like to be connected by connector connection, the connector connection is brought into a waterproof state.

By adopting the waterproof structure in this way, invasion of water into the outer connector portion 229 and into the camera housing 225 can effectively be prevented.

Further, in fabricating the rear case portion 225*b* having the inner connector portion 228 and the outer connector portion 229, for example, in a state of arranging terminal conductors integrally provided with the connector terminals 228*a*, the connection conductors 230 and the connector terminals 229*a* respectively at predetermined positions, the terminal conductors can easily be fabricated by integrally molding the terminal conductors by a resin, for example, by insert molding.

Further, the terminal conductors are integrally provided with the connector terminals 228*a*, the connection conductors 230 and the connector terminals 229*a* are inserted to mount from the side of the outer connector portion 229*a* to be held in a shape of preventing from being drawn out by a pertinently provided lock mechanism after integrally molding the rear case portion 225*b* having the inner connector portion 228 and the outer connector portion 229.

Further, in this case, as the flexible resin forming the rear case portion 225*b*, for example, it is preferable that the rear case portion 225*b* is formed by a resin for a connector of polybutyleneterephthalate (PBT), nylon, polyphenylene sulphide (PPS) or the like. Thereby, the rear case portion 225*b* can easily be formed with a structure for a connector of a locking portion, a locked portion or the like.

Figure 9:
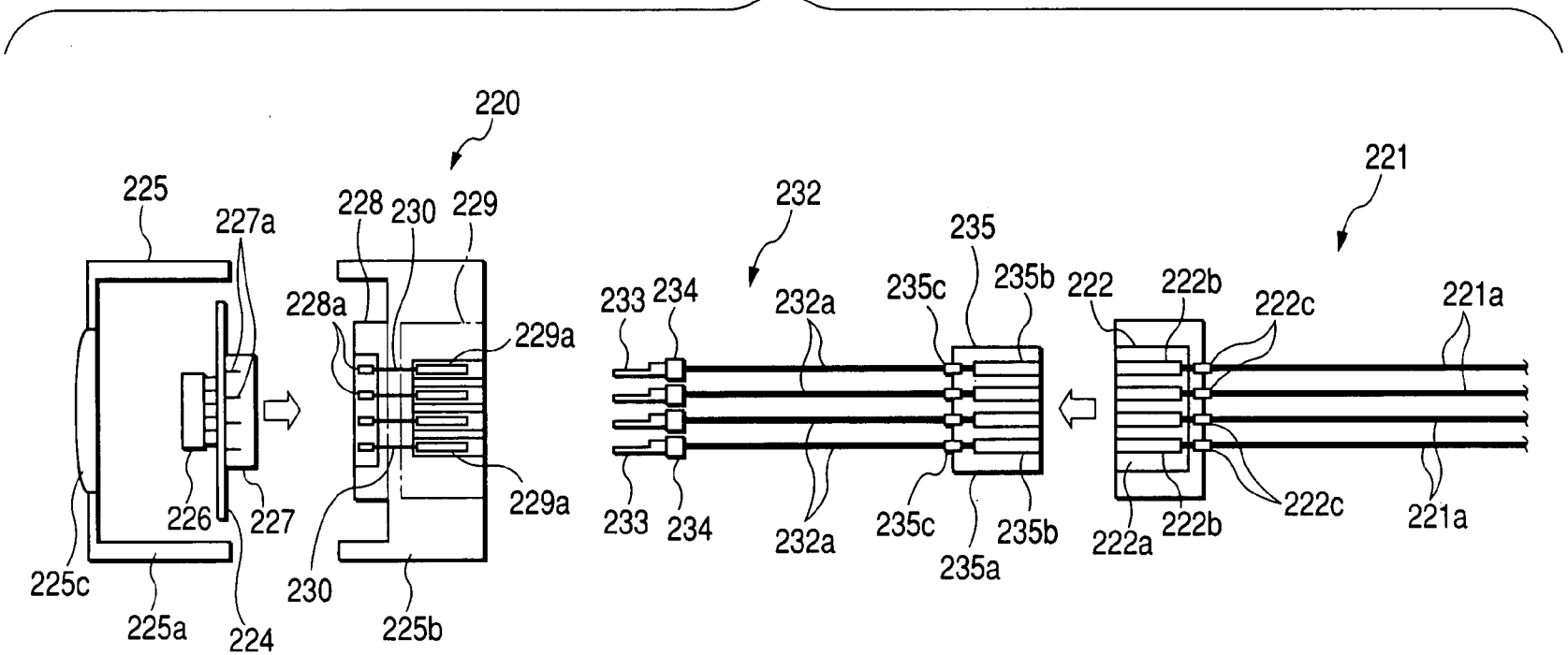
FIG. 9 is a disassembled explanatory view according to a still another embodiment of the invention.
Figure 10:
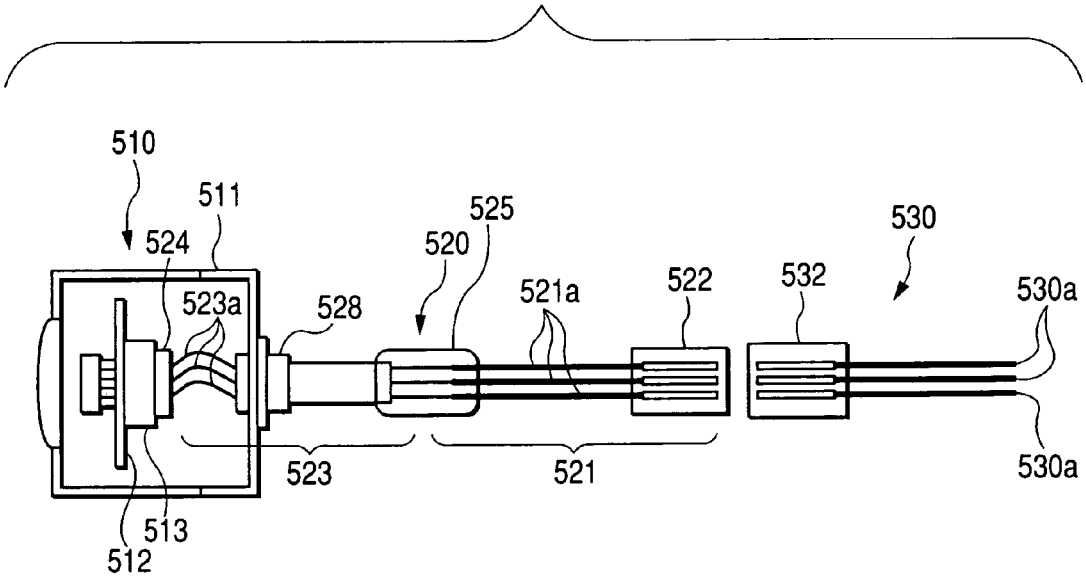
FIG. 10 is a view showing external wirings of a conventional vehicle mounting camera apparatus.

FIG. 9 shows still another embodiment, constituent portions similar to those of the above-described another embodiment are attached with the same notations and an explanation thereof will be omitted.

That is, according to the still another embodiment there is configured by electrically connecting the outer connector portion 229 of the vehicle mounting camera apparatus 220 and the external harness 221 via the relay harness 232.

According to the relay harness 232, a desired number of pieces of electric wires 232*a* having a comparatively bold diameter similar to the electric wires 221*a* are used. Further, since the respective electric wires 232*a* are comparatively short, the respective electric wires 232*a* may not be shielded electric wires. Further, the connection terminals 233 (for example, male terminals) connected to the respective connector terminals 229*a* (for example, female terminals) of the outer connector portion 229 are respectively brought into press contact with one end portions of the respective electric wires 232*a*, and respective waterproof plugs 234 are respectively brought into close contact with inner peripheral faces of respective recess portions in which respective connector terminals 229*a* are contained when the respective connection terminals 233 are respectively connected to the respective connector terminals 229*a* in liquid tight.

Further, other end portions of the respective electric wires 232*a* are attached with a relay connector 235 connectable to the external connector 222 of the external harness 221, the relay connector 235 is respectively integrated with connector terminals 235*b* (for example, female terminals) connected to the respective connector terminals 222*b* (for example, male terminals) of the external connector 222 at inside of a connector housing 235*a*.

Further, End portions of the respective electric wires 232*a* with which the respective connector terminals 235*b* are brought into press contact are respectively mounted with waterproof plugs 235*c* respectively comprising rubber, flexible resin or the like, and in a state of integrating the respective connector terminals 235*b* to the connector housing 235*a*, intervals between the connector housing 235*a* and the respective electric wires 232*a* are respectively sealed by the respective waterproof plugs 235*c* in liquid tight.

Further, in connecting wires to the vehicle mounting camera apparatus 220, by respectively connecting the respective connection terminals 233 mounted to end portions of the respective electric wires 232*a* of the relay harness 232 to the respective connector terminals 229*a* of the outer connector portion 229 integrally formed with the outer face of the rear case portion 225*b* and connecting the relay connector of the other end portion and the external connector 222 of the external harness 221 by connector connection, the circuit board 224 constituting the inner electric apparatus is electrically connected to an external apparatus of an external control apparatus, an external power source or the like via the relay harness 232.

An effect similar to that of the another embodiment is achieved also by the still another embodiment, and the outer connector portion 229 and the external harness 221 can electrically be connected via the relay harness 232, which can deal with a variety of connecting methods.

Further, portions of connecting the respective connector terminals 229*a* of the outer connector portion 229 and the respective connection terminals 233 of the relay harness 232 can effectively prevent invasion of water by the respective waterproof plugs 234.

Further, when a waterproof structure arranged with a water seal member or the like to include a waterproof state when connected by connector connection is adopted between the inner face side of the fitting recess portion of the external connector 222 fitted with the relay connector 235 and the outer face side of the relay connector 235, invasion of water to a portion of connecting these can also be prevented effectively.

Further, there may be constructed a structure of having the relay connectors 235 respectively at both end portions of the relay harness 232 to connect also to the external connector portion 229 by connector connection.

What is claimed is:

1. A vehicle camera mounting apparatus connected to an external apparatus via an external harness, the electric apparatus comprising:

a circuit board; and a camera housing including a connecting portion and a connector terminal formed in the connecting portion, wherein the connecting portion of the housing, via the connector terminal formed therein, is capable of electrically connecting an external connector attached to one end of the external harness.

2. The vehicle camera mounting apparatus according to claim 1, wherein the connection conductor arranged in the camera housing is formed by insert-molding.

3. The vehicle camera mounting apparatus according to 1, wherein the outer connector portion is connectable with a harness side connector provided at an end portion of the external harness.

4. The vehicle camera mounting apparatus according to claim 3, wherein the outer connector portion and the harness side connector are connected to be in a waterproof state.

5. The vehicle camera mounting apparatus according to claim 1, wherein a relay harness having a relay connector one end of which is electrically connected to the outer connector portion and the other end of which is connected with a harness side connector provided at an end portion of the external harness.

6. The vehicle camera mounting apparatus according to claim 5, wherein a portion of connecting the outer connector portion and the relay harness and the relay connector and the harness side connector are respectively connected to be a waterproof state.

* * * * *